US012514425B2

(12) United States Patent
Friedke et al.

(10) Patent No.: US 12,514,425 B2
(45) Date of Patent: Jan. 6, 2026

(54) DOMESTIC DISHWASHER

(71) Applicant: BSH Hausgeräte GmbH, Munich (DE)

(72) Inventors: Aaron Friedke, Gundelfingen (DE); Daniel Miller, Dillingen (DE); Michael Rupp, Holzheim (DE); Manuel Jörg, Lauingen (DE)

(73) Assignee: BSH Hausgeräte GmbH, Munich (DE)

( * ) Notice: Subject to any disclaimer, the term of this patent is extended or adjusted under 35 U.S.C. 154(b) by 108 days.

(21) Appl. No.: 18/578,325

(22) PCT Filed: Jul. 7, 2022

(86) PCT No.: PCT/EP2022/068854
§ 371 (c)(1),
(2) Date: Jan. 11, 2024

(87) PCT Pub. No.: WO2023/285265
PCT Pub. Date: Jan. 19, 2023

(65) Prior Publication Data

US 2024/0298869 A1 Sep. 12, 2024

(30) Foreign Application Priority Data

Jul. 16, 2021 (DE) ..... 102021207588.6

(51) Int. Cl.
*A47L 15/42* (2006.01)

(52) U.S. Cl.
CPC ..... *A47L 15/4257* (2013.01); *A47L 2401/04* (2013.01); *A47L 2401/26* (2013.01)

(58) Field of Classification Search
CPC ..... A47L 15/4257; A47L 15/4259; A47L 2401/04; A47L 2401/26
See application file for complete search history.

(56) References Cited

U.S. PATENT DOCUMENTS

| | | | | |
|---|---|---|---|---|
| 12,331,575 | B2 * | 6/2025 | Pertermann | A47L 15/4274 |
| 2018/0168429 | A1 | 6/2018 | Rittner | |
| 2018/0325353 | A1 | 11/2018 | Isbilen | |
| 2019/0200841 | A1 * | 7/2019 | Yoshimoto | A47L 15/42 |
| 2023/0240508 | A1 | 8/2023 | Daniel | |

FOREIGN PATENT DOCUMENTS

| | | | | |
|---|---|---|---|---|
| CN | 105361833 | B * | 6/2018 | A47L 15/4295 |
| DE | 102011079534 | A1 | 1/2013 | |
| DE | 102015211495 | A1 * | 12/2016 | A47L 15/506 |
| DE | 102016209117 | A1 * | 11/2017 | A47L 15/0049 |
| DE | 102017114984 | A1 | 1/2018 | |
| DE | 102016222321 | A1 | 5/2018 | |

(Continued)

OTHER PUBLICATIONS

Translation of DE 102011079534 (Year: 2013).*

(Continued)

*Primary Examiner* — Michael E Barr
(74) *Attorney, Agent, or Firm* — Michael E. Tschupp; Andre Pallapies; Brandon G. Braun

(57) ABSTRACT

A household dishwasher includes a washing items receptacle and a sensor unit which is designed to generate a sensor signal as a function of a change in position of the washing items receptacle and/or a force exerted on the washing items receptacle.

13 Claims, 6 Drawing Sheets

(56) References Cited

FOREIGN PATENT DOCUMENTS

| | | | | |
|---|---|---|---|---|
| DE | 102017201223 | A1 | 7/2018 | |
| DE | 102017213699 | A1 | 2/2019 | |
| DE | 102018130699 | A1 | 6/2020 | |
| KR | 101122791 | B1 * | 3/2012 | ..... A47L 15/50 |
| WO | 2007048544 | A1 | 5/2007 | |
| WO | 2017202574 | A1 | 11/2017 | |

OTHER PUBLICATIONS

Translation of DE 102016222321 (Year: 2018).*
Translation of DE 102016209117 (Year: 2017).*
Translation of DE 102015211495 (Year: 2016).*
Translation of KR 10112791 (Year: 2012).*
Translation of CN 105361833 (Year: 2018).*
Translation of DE 102018130699 (Year: 2020).*
National Search Report DE 10 2021 207 588.6 dated Apr. 6, 2022.
International Search Report PCT /EP2022/068854 dated Oct. 11, 2022.

* cited by examiner

DOMESTIC DISHWASHER

CROSS-REFERENCES TO RELATED APPLICATIONS

This application is the U.S. National Stage of International Application No. PCT/EP2022/068854, filed Jul. 7, 2022, which designated the United States and has been published as International Publication No. WO 2023/285265 A1 and which claims the priority of German Patent Application, Serial No. 10 2021 207 588.6, filed Jul. 16, 2021, pursuant to 35 U.S.C. 119 (a)-(d).

The contents of International Application No. PCT/EP2022/068854 and German Patent Application, Serial No. 10 2021 207 588.6 are incorporated herein by reference in their entireties as if fully set forth herein.

BACKGROUND OF THE INVENTION

The present invention relates to a household dishwasher.

There is an increasing desire to simplify household dishwashers. One aspect of this is to detect electronically a wish on the part of a user to open the door.

The publication DE 10 2010 037 397 A1 discloses a household dishwasher with an opening drive mechanism set up to move the door from a closed position to a partially opened position. A sensor is provided to recognize an acoustically expressed wish to open on the part of a user.

The publications EP 1 935 313 B1 and EP 2 280 631 B1 disclose a household dishwasher with a door and a decorative panel supported in a sprung manner on the door. A sensor is also provided to detect movement of the decorative panel relative to the door and an associated wish to open.

The publication EP 2 497 405 A2 discloses a household dishwasher with a knock sensor for detecting an acoustic knocking signal input by a user and with an analysis unit.

BRIEF SUMMARY OF THE INVENTION

With this in mind, it is an object of the present invention to provide an improved household dishwasher.

The household dishwasher therefore has a washing items receptacle and a sensor unit, which is set up to generate a sensor signal as a function of a change in position of the washing items receptacle and/or a force exerted thereon.

The washing items receptacle can therefore advantageously be used in particular as an operating element for the household dishwasher.

A "washing items receptacle" here is a receptacle, in particular a rack, for holding items to be washed, for example plates, cups, flatware or bowls. In particular it can be an upper washing items receptacle or a lower washing items receptacle, also known as an upper rack and lower rack, or a flatware drawer.

Provision can be made for multiple washing items receptacles to be provided and for the sensor unit to detect a change in position of multiple washing items receptacles and/or a force exerted on multiple washing items receptacles. Provision can however also be made for multiple sensor units to be provided and for each sensor unit to detect the change in position of a respectively assigned washing items receptacle and/or the force exerted on a respectively assigned washing items receptacle.

A "change in position" here refers to a translational and/or rotational movement of the washing items receptacle. The translational movement can be along one, two and/or or three (in particular mutually orthogonal) axes. The rotational movement can be about one, two and/or three (in particular mutually orthogonal) axes. The change in position can also be a movement, which comprises both a translation and a rotation along or about the one, two and/or three axes. The movement is in particular a movement triggered by a short pulse.

A "force exerted", in particular a change in force, here is a force applied to the washing items receptacle, which is measured directly by the sensor unit. The force exerted on the washing items receptacle can be produced in particular by a person or by a robot.

In particular a user can produce the change in position of the washing items receptacle and/or force exerted thereon indirectly or directly. Direct exertion means that the user acts directly with their hand or another part of the body on the washing items receptacle. Indirect exertion means that one or more further parts of the household dishwasher are connected between the force exerted by the user and the washing items receptacle, for example a door. The user therefore pushes on the door, thereby moving the washing items receptacle (change in position).

According to one embodiment a control unit is provided, which is set up to recognize a user interaction by a user with the household dishwasher and/or an error state of the household dishwasher.

The user interaction can be in particular a wish to open the door on the part of the user. Other types of interaction can be for example the selection of a specific wash program, an inward or outward movement of the washing items receptacle and/or the operation of a user interface.

Provision can be made for example for the household dishwasher to have a wash container and a door to close or open the wash container. When the door is closed, the user of the household dishwasher can act on or push the door for example so that this brings about a change in position of the washing items receptacle. In this instance the door and the washing items receptacle are coupled to one another so that a force exerted on the door produces a change in position of the washing items receptacle. To achieve this, the washing items receptacle can be pushed onto the door for example by means of a spring system.

However the washing items receptacle can also be used to recognize an error state. An error state can be in particular the overloading of the washing items receptacle. A further error state can involve an object blocking or preventing the inward or outward movement of the washing items receptacle. Yet another error state can comprise one or multiple defective parts of the household dishwasher.

In particular one or multiple target changes in position of the washing items receptacle and/or target forces exerted thereon can be stored on the control unit or a data storage unit thereof. Such target values are compared with actual changes in position and/or actual forces exerted detected by the sensor unit to determine an error state.

When the control unit recognizes an error state, the control unit can be set up to activate an alarm facility of the household dishwasher. An alarm facility can be an acoustic and/or visual alarm facility for example. Alternatively or additionally the control unit can inform the user of the error state by way of an application of an external device, for example a smartphone.

According to one embodiment an actuator and a control unit are provided, the control unit being set up to activate the actuator as a function of the sensor signal.

The actuator is in particular an electric motor.

According to one embodiment the actuator is set up to move the washing items receptacle into and/or out of a wash container of the household dishwasher and/or to raise and/or lower the washing items receptacle.

In particular the actuator can move the washing items receptacle (or alternatively the door of the household dishwasher) directly or by means of a transmission system, for example with a gear wheel and/or lever. In the case of the door, the actuator pivots it at least to some degree.

In particular it is conceivable for the user of the household dishwasher to move the washing items receptacle in an outward or inward movement direction. This change in position is perceived by a control unit as a user interaction indicating that the user wishes to move the washing items receptacle out or in. In response to this user interaction the control unit activates the actuator, which is set up to move the washing items receptacle automatically out of or into the wash container. It is also conceivable for the actuator only to provide power assistance for the outward or inward movement by the user.

However the actuator can also be used to raise and/or lower the washing items receptacle. It is conceivable for example for the washing items receptacle to be a lower washing items receptacle, which is raised as it moves out, to enhance user convenience when loading and/or unloading the dishwasher. The actuator can then also raise and/or lower the washing items receptacle automatically or provide power assistance for the user when raising and/or lowering the washing items receptacle.

According to one embodiment a wash container and a door for closing or opening the wash container are provided, the actuator being set up to open and/or close and/or to unlock and/or lock the door.

Provision can be made for example, when the door closes the wash container, for the user to push the door in the direction of the wash container and for this force exerted by the user on the door to result in a change in position of the washing items receptacle. Said change in position is detected by the sensor unit and interpreted by the control unit as a wish to open the door. It then activates the actuator so that a door lock of the door is unlocked and/or the door is opened by at least a gap.

Provision can also be made for the user to move the washing items receptacle in the direction of the wash container. This movement produces a change in position of the washing items receptacle, which is detected by the sensor unit. Said change in position is recognized by the control unit as a wish to close the door. It then activates the actuator so that the door is closed and the door is locked by a door lock.

According to one embodiment a damping element is provided, arranged between the washing items receptacle and the door when the door is closed and set up to dampen any impact between the door and the washing items receptacle respectively.

This prevents damage to the washing items receptacle and the door.

The damping element can be for example a material with damping properties, such as an elastomer. Further possible damping elements include for example spring systems or magnetic systems.

According to one embodiment a detection facility is provided, which is set up to generate a further sensor signal as a function of a user interaction, the control unit being set up to activate the actuator as a function of the (first) sensor signal and the further (second) sensor signal.

This in particular creates a redundant system, with which for example possible misinterpretations of the first sensor signal are reduced or excluded.

According to one embodiment a user interface and a control unit are provided, the control unit being set up to activate the user interface as a function of the sensor signal.

According to one embodiment the user interface is set up to output an acoustic and/or visual output signal to a user of the household dishwasher, the control unit being set up to activate the user interface to output the acoustic and/or visual output signal.

The user interface can be a light, a display and/or a speaker. The user interface can also be integrated in a device, in particular a smartphone, separate from the household dishwasher. The household dishwasher then comprises a communication module, for example a WLAN module, for communication with the user interface. The control unit then activates the communication module as a function of the sensor signal.

According to one embodiment the sensor unit is set up to detect the change in position of the washing items receptacle and/or the force exerted thereon along and/or about one, two or three axes.

Provision can thus be made for a multidimensional change in position and/or a multidimensional force exerted to be detected by the sensor unit.

According to one embodiment a wash container is provided, the sensor unit being arranged in or on the wash container.

Provision can however also be made for the sensor unit to be arranged in or on a door of the household dishwasher.

According to one embodiment the sensor unit is set up to detect the change in position of the washing items receptacle and/or the force exerted thereon capacitively, inductively, resistively, optically or acoustically.

In particular the sensor unit can be configured as an encoder or camera (for example a CCD chip).

According to one embodiment the control unit is set up to recognize a user interaction of a user with the household dishwasher and/or an error state of the household dishwasher as a function of the sensor signal during a first time period and to activate the actuator as a function of the sensor signal during a second time period.

In particular parts of the control unit for recognizing the user interaction or error state and parts of the control unit for controlling the actuator can be provided thereon or different hardware (in particular a microprocessor). The parts themselves can in turn be configured as software or hardware.

The household dishwasher preferably has a control loop, comprising the sensor unit, the control unit and the actuator, the actuator being controlled as a function of the sensor signal, even if no user interaction takes place. The sensor signal here is used as feedback for control of the actuator movement.

In other words the sensor unit can already be present in the household dishwasher for other purposes, in particular for monitoring partially or fully automatic movement of the washing items receptacle, also referred to as automatic rack movement or ARM. The sensor unit here advantageously has an additional function (twin function), specifically in particular to detect a user interaction (for example a wish to open the door).

According to one embodiment a control device, which is set up to prompt the household dishwasher to perform one or more wash programs, and a control unit are provided, the latter being set up to influence the one or more wash programs as a function of the sensor signal.

Provision can be made for example for the sensor unit to detect the load state of the washing items receptacle and for the control unit to adjust wash parameters, for example the wash time, for one or more wash programs based on the determined load state.

The units cited here, in particular the control unit, can be configured as hardware and/or software.

Further possible implementations of the invention comprise combinations of features or embodiments described above or in the following with regard to the exemplary embodiments even if these are not cited specifically. The person skilled in the art will also add individual aspects to improve or complete the respective basic form of the invention.

BRIEF DESCRIPTION OF THE DRAWINGS

Further advantageous configurations and aspects of the invention are set out in the subclaims and the exemplary embodiments of the invention described in the following. The invention is also described in more detail based on preferred embodiments with reference to the accompanying figures, in which

DETAILED DESCRIPTION OF EXEMPLARY EMBODIMENTS OF THE PRESENT INVENTION

Figure 1:
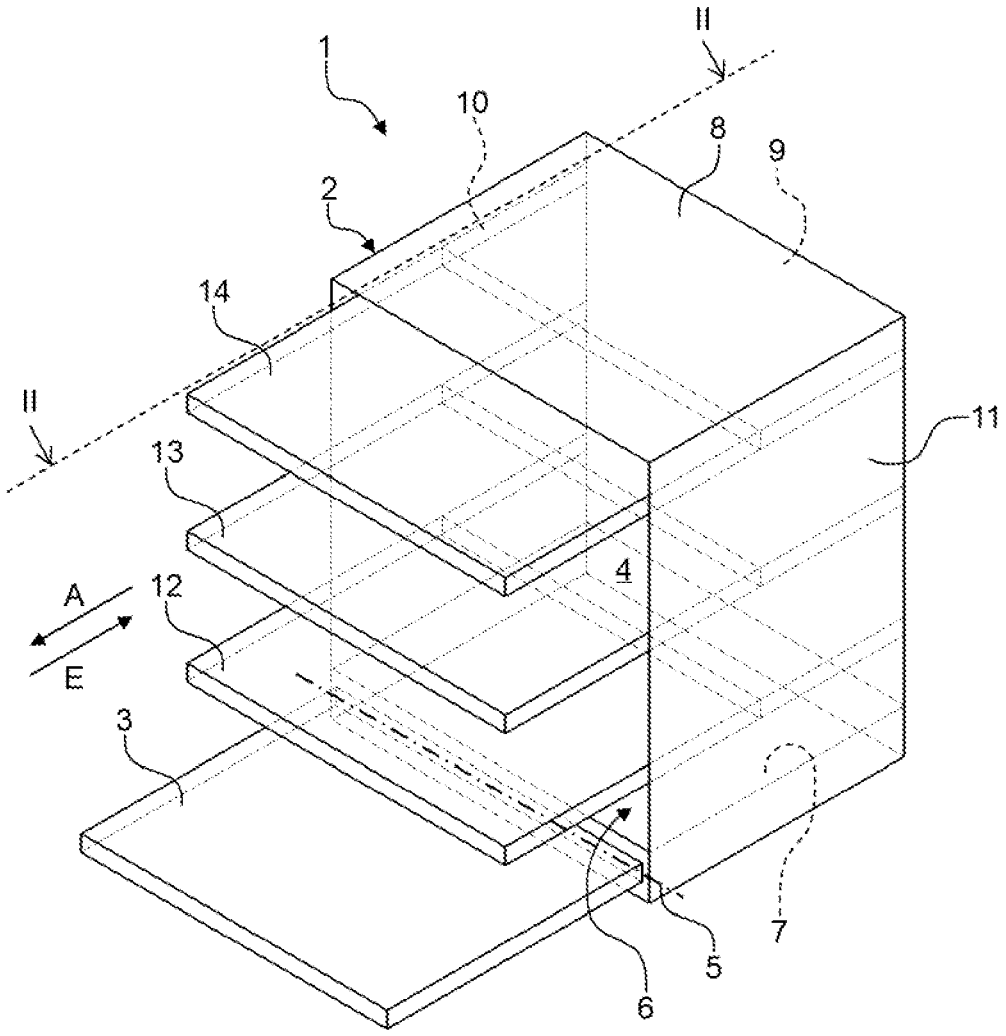
FIG. 1 shows a schematic perspective view of an embodiment of a household dishwasher.

Identical elements or those of identical function are shown with the same reference characters in the figures, unless otherwise specified.

FIG. 1 shows a schematic perspective view of an embodiment of a household dishwasher 1. The household dishwasher 1 comprises a wash container 2, which can be closed, in particular in a water-tight manner, by a door 3. To this end a sealing facility (not shown in detail here) can be provided between the door 3 and the wash container 2. The wash container 2 is preferably box-shaped. The wash container 2 can be arranged in a housing of the household dishwasher 1. The wash container 2 and door 3 can form a wash chamber 4 for washing items to be washed.

The door 3 is shown in its opened position in FIG. 1. The door 3 can be closed or opened by pivoting about a pivot axis 5 provided at a lower end of the door 3. A loading opening 6 of the wash container 2 can be closed or opened with the aid of the door 3. The wash container 2 has a base 7, a top 8 positioned opposite the base 7, a rear wall 9 positioned opposite the closed door 3 and two opposing side walls 10, 11. The base 7, top 8, rear wall 9 and side walls 10, 11 can be made of stainless steel sheet for example. Alternatively the base 7 for example can be made of a plastic material.

The household dishwasher 1 also has at least one washing items receptacle 12 to 14. Multiple, for example three, washing items receptacles 12 to 14 can preferably be provided, the washing items receptacle 12 being a lower washing items receptacle or lower rack, the washing items receptacle 13 an upper washing items receptacle or upper rack and the washing items receptacle 14 a flatware drawer. As also shown in FIG. 1, the washing items receptacles 12 to 14 are arranged one above the other in the wash container 2. Each washing items receptacle 12 to 14 can be moved into or out of the wash container 2 as required. In particular each washing items receptacle 12 to 14 can be pushed or moved into the wash container 2 in a push-in direction E (arrow) and be pulled or moved out of the wash container 2 in a pull-out direction A (arrow) counter to the push-in direction E (arrow).

Figure 2:
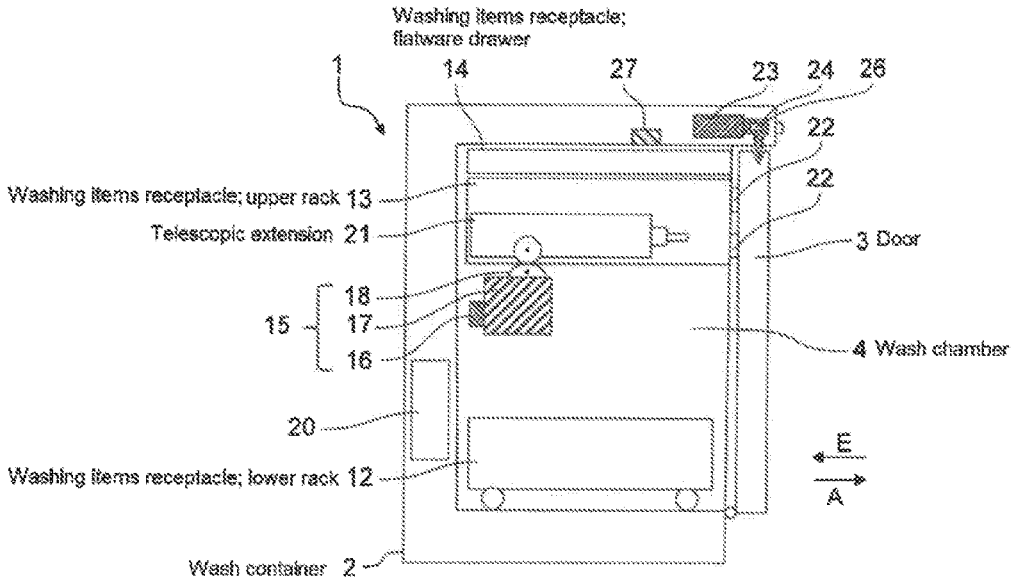
FIG. 2 shows a section II-II from FIG. 1, with the door in its closed state.
Figure 3:
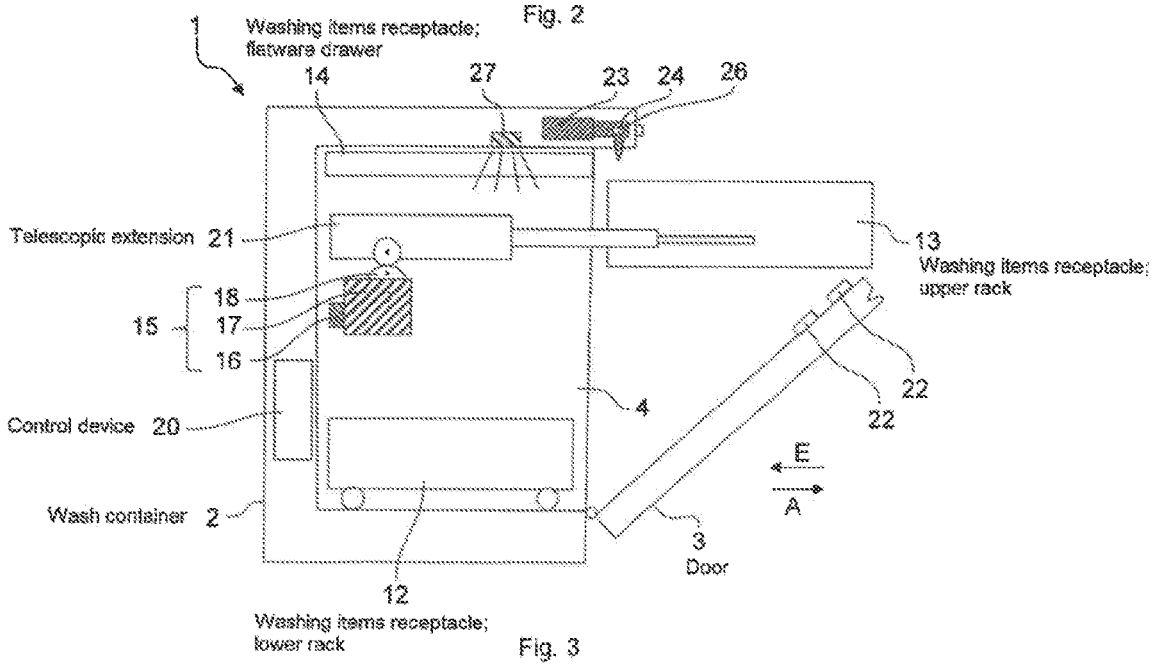
FIG. 3 shows the view from FIG. 2, with the door in its opened state.

FIGS. 2 and 3 each show a section II-II from FIG. 1. In FIG. 2 the door 3 of the household dishwasher 1 is shown in its closed position and in FIG. 3 it is shown in its opened position.

The household dishwasher 1 has an apparatus 15 for the automatic inward or outward movement (automatic rack movement, hereafter ARM) of the upper washing items receptacle 13 into or out of the wash container 2.

Figure 4:
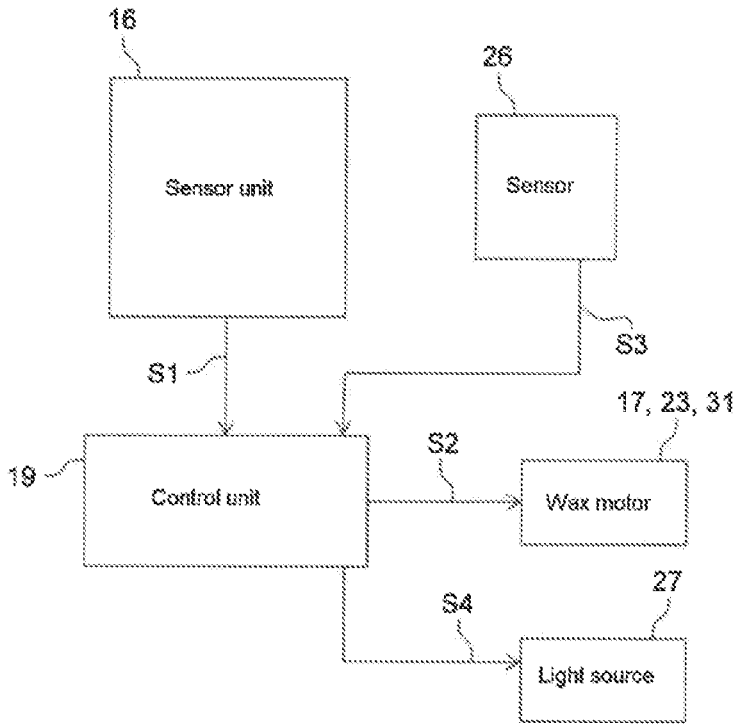
FIG. 4 shows a schematic diagram of an embodiment of the electronic controller of a household dishwasher.

The apparatus 15 comprises for example a sensor unit 16, an actuator 17 and a transmission system 18. A control unit 19 (see FIG. 4) can also be part of the apparatus 15. The control unit 19 can however also be part of a central control device 20 of the household dishwasher 1.

The sensor unit 16 is set up to detect a change in position of the upper washing items receptacle 13. A change in position refers in particular to a translational movement of the upper washing items receptacle 13 in the push-in direction E (inward direction; arrow) and/or in the pull-out direction A (outward direction; arrow). The sensor unit 16 is preferably an encoder. The sensor unit 16 is connected for signal purposes to the control unit 19 shown schematically in FIG. 4. When the sensor unit 16 detects a change in position of the upper washing items receptacle 13, the sensor unit 16 generates a sensor signal S1.

The actuator 17 is preferably an electric motor and is activated by the control unit 19. The actuator 17 drives the transmission system 18. The transmission system 18 in particular drives the upper washing items receptacle 13 by way of a rack (not shown in detail here). It is supported by means of a telescopic extension 21 on the wash container 2 and can be moved into or out of this. The actuator 17 is set up either to execute automatically or to assist (power assistance) an outward and/or inward movement of the upper washing items receptacle 13 in the pull-out direction A (arrow) or in the push-in direction E (arrow).

The control unit 19 is set up in particular to recognize one or more (even different) user interactions as a function of the sensor signal S1. The user interaction can be a wish to open the door, expressed for example by the user of the household dishwasher 1 pushing the door 3. This brings about a change in position of the upper washing items receptacle 13. The control unit 19 recognizes a wish to open the door, when the change in position of the upper washing items receptacle 13 is for example between 1% and 5% of the length of pull-out movement. The length of pull-out movement here refers to the length covered as a maximum by the upper washing items receptacle 13 during the inward or outward movement (referring to the distance between the maximum inward and maximum outward position).

Recognition of the wish to open the door can be acted on in different ways by the control unit 19:

According to a first embodiment the control unit 19 activates an actuator in the form of a wax motor 23 by means of a control signal S2. The wax motor 23 unlocks a door lock 24 of the door 3, so that the door 3 opens with a wide gap subject to the action of a spring (not shown in detail here).

According to a second embodiment provision is made for the control unit 19 to activate the actuator 17 by means of the control signal S2 so that the upper washing items receptacle 13 is pushed against the inner face of the door 3. When the force exerted by the upper washing items receptacle 13 on the inner face of the door 3 exceeds a threshold value, the door 3 opens. The upper washing items receptacle 13 is then moved further out in the pull-out direction A (arrow) and the door 3 is opened further subject to the action of the upper washing items receptacle 13.

The first and second embodiments can also be combined. It is therefore possible for the door lock 24 to be unlocked first subject to the action of the wax motor 23 and for the door 3 then to be opened subject to the action of an outward movement of the upper washing items receptacle 13.

The user interaction can also be a wish to close the door. For this purpose the user moves the upper washing items receptacle 13 in the push-in direction E (arrow) from the position shown in FIG. 3. The resulting change in position is detected by the sensor unit 16. It generates a sensor signal S1, from which the control unit 19 recognizes a wish to close the door.

When the wish to close the door is recognized, the control unit 19 activates the actuator 17 so that the upper washing items receptacle 13 is moved in the push-in direction E (arrow) and thus moved inward.

Figure 5:
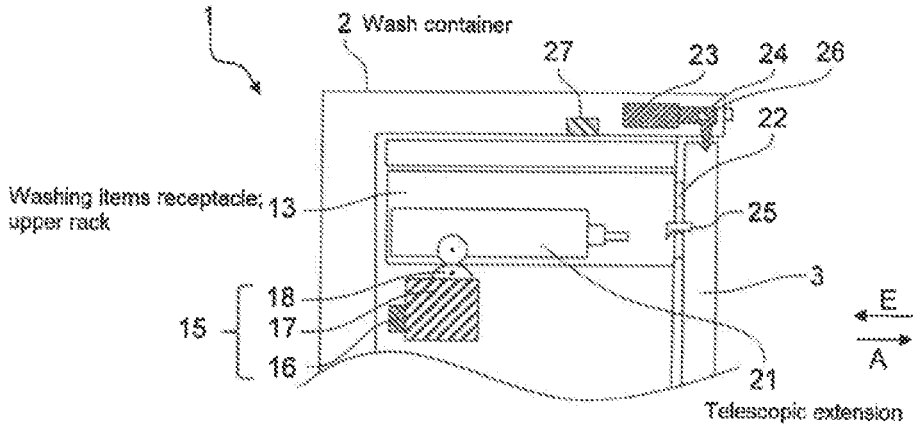
FIG. 5 is an enlargement of the view from FIG. 2, with a coupling facility also provided.

The upper washing items receptacle 13 is preferably coupled mechanically to the door 3 by means of a coupling facility shown in FIG. 5 and embodied as a hook 25. The hook 25 is attached to the door 3 and latches in the upper washing items receptacle 13. The door 3 and upper washing items receptacle 13 can be uncoupled by the user by said user opening the door 3 wider, when the upper washing items receptacle 13 is moved outward—partially or completely, depending on the embodiment. This causes the hook 25 to unlatch from the upper washing items receptacle 13. To latch the hook 25 back into the upper washing items receptacle 13, the user closes the door 3 again at least partially, in particular to the extent that the door 3 comes into contact with the upper washing items receptacle 13 (or just before this).

The hook 25 causes the upper washing items receptacle 13 to pull the door 3 with it as it moves inward. This causes the door 3 to close. When the door 3 closes, the control unit 19 activates the wax motor 23 so that the door lock 24 is locked.

The household dishwasher 1 preferably has damping elements 22. The damping elements 22 can in particular be fastened either to the upper washing items receptacle 13 or to the inner face of the door 3. They serve to dampen any impact of the door 3 against the upper washing items receptacle 13 (or vice versa) thus reducing the risk of damage to the upper washing items receptacle 13 and/or the door 3. The damping elements 22 can be made of an elastomer for example.

In a further possible embodiment the control unit 19 is set up to move the upper washing items receptacle 13 into the wash container 2 automatically or with power assistance as a function of the sensor signal S1, without closing the door 3. This is the case for example when the upper washing items receptacle 13 and door 3 are not coupled mechanically because the hook 25 is not latched in.

To create a redundant system, which is less error-prone, a detection facility embodied as a sensor 26 (see FIGS. 4 and 5) for the door lock 24 can be provided to open the door. This is set up to detect a wish to open the door. When the sensor 26 detects a wish to open the door, it generates a sensor signal S3. The control unit 19 then only opens the door 3 when it recognizes a wish to open the door as a function of the sensor signal S1 and the further sensor signal S3.

The control unit 19 can also be set up to activate a user interface as a function of the sensor signal S1. In the embodiment in FIGS. 2 and 3 a light source 27 is arranged on the top 8 of the wash container 2. When the control unit 19 recognizes a wish to open the door, the light source 27 is activated and therefore switched on by the control unit 19 by means of a control signal S4. The light source 27 can then remain switched on for a predetermined time, before it is switched off. Provision can also be made for the light source 27 to be switched on during an outward movement of the upper washing items receptacle 13 and to be switched off during an inward movement of the upper washing items receptacle 13. The light source 27 is shown in the switched on state in FIG. 3, as the upper washing items receptacle 13 has been moved out of the wash container 2 and in the switched off state in FIG. 2, as the upper washing items receptacle 13 has been moved into the wash container 2.

The control unit 19 can also activate a further acoustic and/or visual user interface, for example a smartphone. This allows information to be sent to the user of the household dishwasher 1. For example the user can learn whether the door 3 is open or closed or whether the light source 27 is switched on or off.

The control unit 19 can also be set up to recognize an error state of the household dishwasher 1. An error state is for example the overloading of the upper washing items receptacle 13.

Figure 6:
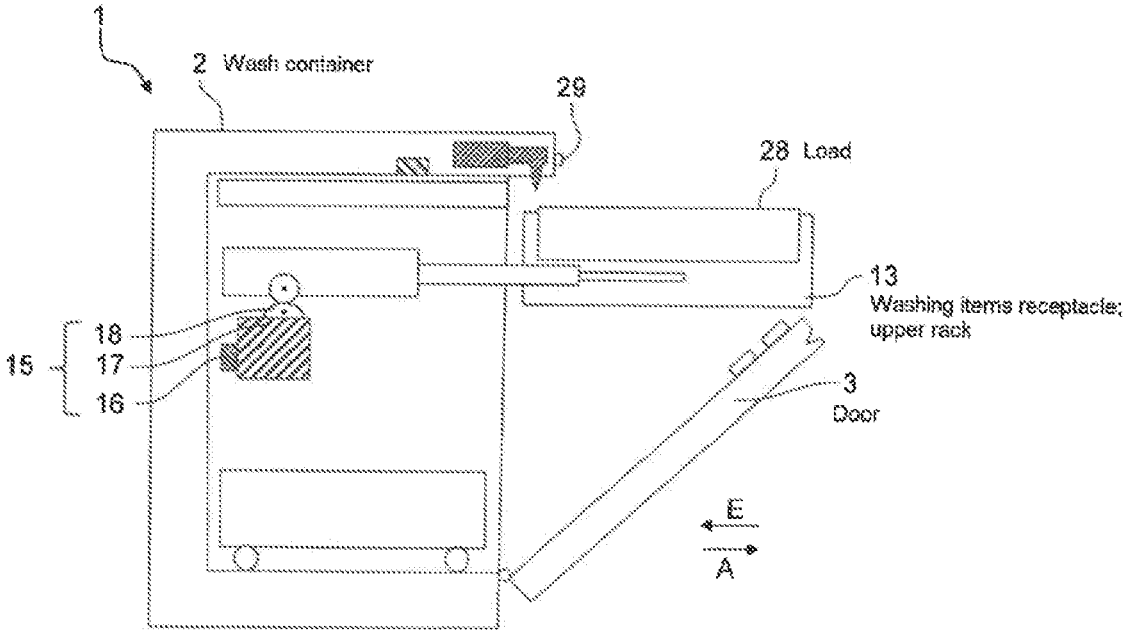
FIG. 6 shows the view from FIG. 3, with a weight acting on the upper washing items receptacle.

An overload situation is shown schematically in FIG. 6. The sensor unit 16 detects a force exerted on the upper washing items receptacle 13. The force applied to the upper washing items receptacle 13 (not a change in position) is measured directly here, for example capacitively or resistively by means of a strain gauge.

If the weight of a load 28 in the upper washing items receptacle exceeds a previously determined threshold value, the control unit 19 recognizes an error state of the household dishwasher 1 and activates a warning light 29 for example.

The control unit 19 can also be set up to adjust a wash program stored on the control device 20 as a function of the sensor signal S1, which is representative of the weight of the load 28. In particular the quantity of water used during the wash can be set as a parameter of the wash program based on the detected weight.

Figure 7:
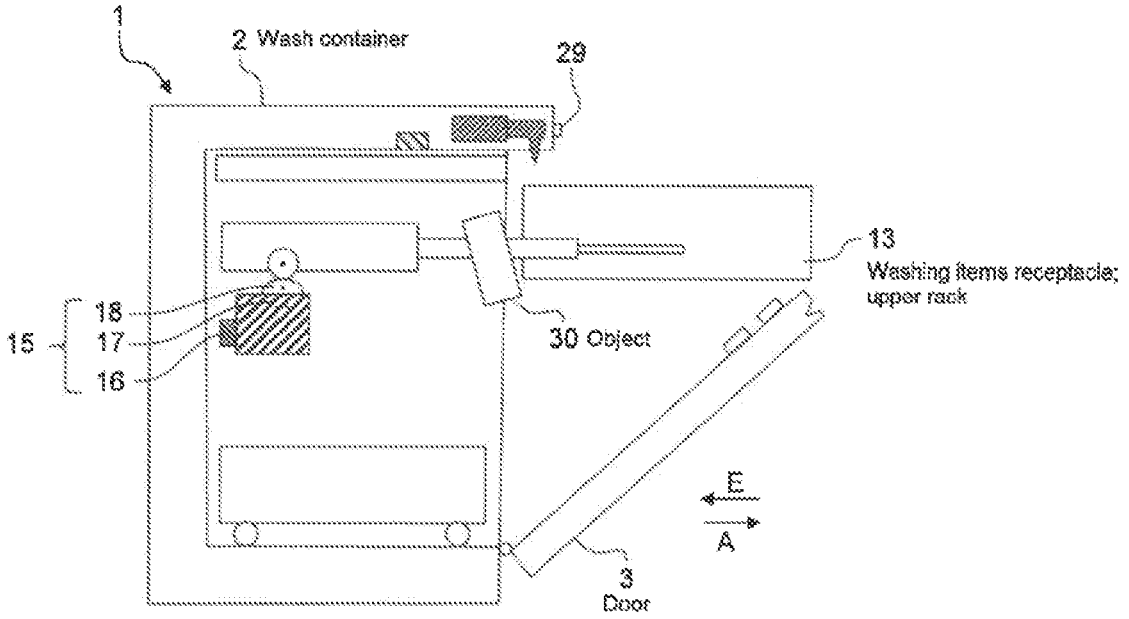
FIG. 7 shows the view from FIG. 3, with an object preventing the inward movement of the upper washing items receptacle into the wash container.

An error state can also be where an object 30 impedes the inward movement of the upper washing items receptacle 13, as shown in FIG. 7. The sensor unit 16 here detects an actual movement pattern of the upper washing items receptacle 13. The control unit 19 compares this with a target movement pattern. The target movement pattern is representative of an inward movement of the upper washing items receptacle 13 into the wash container 2, when it is not blocked by the object 30. If the actual movement pattern and the target movement pattern are different, the control unit 19 recognizes an error state of the household dishwasher 1. The control unit 19 then activates the actuator 17 for example so that the upper washing items receptacle 13 is halted. This prevents possible injury to people and/or damage to the household dishwasher 1. The warning light 29 can also be switched on here to inform the user of the household dishwasher 1 of the error state.

The comparison of the actual and target movement patterns can also be used to recognize further error states, for example a fault in the apparatus 15, of the household dishwasher 1.

Figure 8:
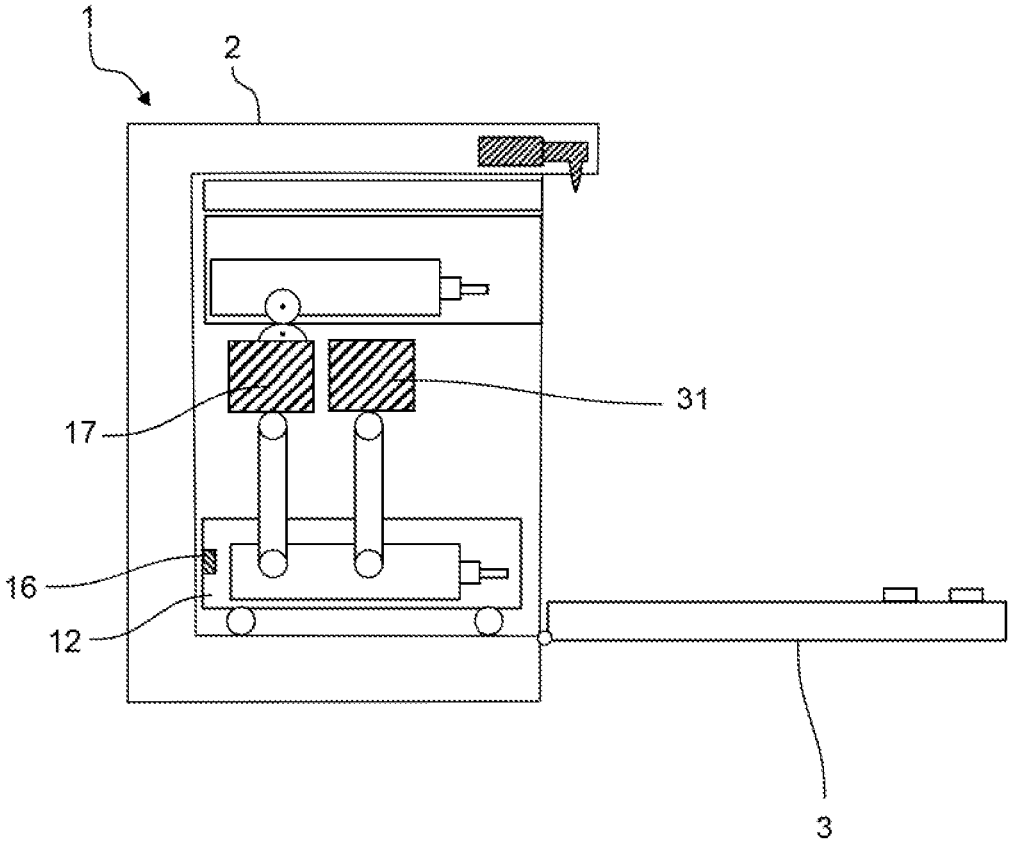
FIG. 8 shows a section corresponding to FIG. 3 of a household dishwasher according to a further embodiment.

In the embodiment in FIG. 8 the sensor unit 16 detects a change in position of the lower washing items receptacle 12. This can be pivoted out and/or in (lower rack elevation or LRE) by means of an apparatus 31. The references above to the upper washing items receptacle 13 apply correspondingly.

Figure 9:
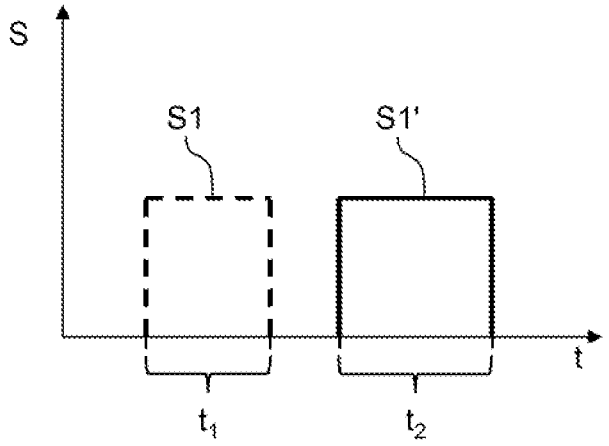
FIG. 9 shows a sensor signal as a function of time.

FIG. 9 shows a sensor signal S as a function of time t. During a first time period $t_1$ the sensor unit 16 recognizes a change in position of the upper washing items receptacle 13, brought about by a user interaction. The sensor unit 16 then generates a sensor signal S1, shown with a broken line in FIG. 9. From this the control unit 19 recognizes the wish to open the door and it activates the actuator 17 to move the upper washing items receptacle 13 accordingly. The sensor unit 16 in turn detects this movement and sends it to the control unit 19 (sensor signal S1' with solid line). The sensor signal S1' is therefore not recognized as a user interaction during the second time period $t_2$ but is used as feedback for control of the actuator movement.

Although the present invention has been described with reference to exemplary embodiments, it can be modified in many different ways.

The invention claimed is:

1. A household dishwasher, comprising:

a wash container;

a washing items receptacle;

a door designed to close or open the wash container;

a sensor unit designed to generate a sensor signal as a function of a change in position of the washing items receptacle and/or a force exerted on the washing items receptacle;

an actuator designed to open and/or close and/or to unlock and/or lock the door; and a control unit designed to activate the actuator as a function of the sensor signal.

2. The household dishwasher of claim 1, wherein the control unit is further designed to recognize a user interaction by a user with the household dishwasher and/or an error state of the household dishwasher as a function of the sensor signal.

3. The household dishwasher of claim 2, wherein the user interaction is with the door or the washing items receptacle and/or the error state is an overloading of the washing items receptacle.

4. The household dishwasher of claim 1, further comprising an additional actuator designed to move the washing items receptacle into and/or out of the wash container and/or to raise and/or lower the washing items receptacle, wherein the control unit is further designed to activate the additional actuator as the function of the sensor signal.

5. The household dishwasher of claim 1, further comprising a coupling facility designed to couple the washing items receptacle to the door so as to open and/or close the door.

6. The household dishwasher of claim 1, further comprising a damping element arranged between the washing items receptacle and the door when the door is closed and designed to dampen any impact between the door and the washing items receptacle respectively.

7. The household dishwasher of claim 1, further comprising a detection facility designed to generate a further sensor signal as a function of a user interaction, said control unit designed to activate the actuator as a function of the sensor signal and the further sensor signal.

8. The household dishwasher of claim 1, further comprising:

a user interface; and wherein the control unit is further designed to activate the user interface as a function of the sensor signal.

9. The household dishwasher of claim 8, wherein the user interface is designed to output an acoustic and/or visual output signal to a user of the household dishwasher, said control unit designed to activate the user interface to output the acoustic and/or visual output signal.

10. The household dishwasher of claim 1, wherein the sensor unit is designed in at least one of two ways, a first way in which the sensor unit is designed to detect the change in position of the washing items receptacle and/or the force exerted on the washing items receptacle along and/or about one, two or three axes, a second way in which the sensor unit is designed to detect the change in position of the washing items receptacle and/or the force exerted on the washing items receptacle capacitively, inductively, resistively, optically or acoustically.

11. The household dishwasher of claim 1, wherein the sensor unit is arranged in or on the wash container.

12. The household dishwasher of claim 1, wherein the control unit is designed to recognize a user interaction of a user with the household dishwasher and/or an error state of the household dishwasher as a function of the sensor signal during a first time period and to activate the actuator as a function of the sensor signal during a second time period.

13. The household dishwasher of claim 1, further comprising:

a control device designed to prompt the household dishwasher to perform one or more wash programs; and wherein the control unit is further designed to influence the one or more wash programs as a function of the sensor signal.

* * * * *